US006811626B2

(12) United States Patent
Serizawa et al.

(10) Patent No.: US 6,811,626 B2
(45) Date of Patent: Nov. 2, 2004

(54) GAS-GENERATING COMPOSITIONS

(75) Inventors: Kazuya Serizawa, Handa (JP); Katsuhiko Takahashi, Aichi-ken (JP)

(73) Assignee: NOF Corporation, Tokyo (JP)

( * ) Notice: Subject to any disclaimer, the term of this patent is extended or adjusted under 35 U.S.C. 154(b) by 0 days.

(21) Appl. No.: 09/952,840

(22) Filed: Sep. 14, 2001

(65) Prior Publication Data

US 2002/0059969 A1 May 23, 2002

(30) Foreign Application Priority Data

Sep. 22, 2000 (JP) ..... 2000-288839

(51) Int. Cl.[7] ..... C06B 45/10; C06B 31/28

(52) U.S. Cl. ..... 149/19.1; 149/19.4; 149/19.7; 149/46

(58) Field of Search ..... 149/45, 46, 19.1, 149/19.4, 19.7, 48, 92

(56) References Cited

U.S. PATENT DOCUMENTS

| | | | | |
|---|---|---|---|---|
| 3,388,990 A | | 6/1968 | Maruta et al. | |
| 3,779,821 A | * | 12/1973 | Fujiki et al. | 149/7 |
| 5,417,895 A | | 5/1995 | Oberth | 264/3.1 |
| 5,472,532 A | | 12/1995 | Wallace, II | 149/17.4 |
| 5,507,891 A | * | 4/1996 | Zeigler | 149/47 |
| 6,143,103 A | * | 11/2000 | Ryder | 149/46 |
| 6,368,432 B2 | * | 4/2002 | Serizawa et al. | 149/46 |

FOREIGN PATENT DOCUMENTS

| | | | |
|---|---|---|---|
| EP | 0 655 429 A1 | 5/1995 | C06B/45/10 |
| EP | 0 913 375 A1 | 5/1999 | C06D/5/00 |
| EP | 0 997 450 A1 | 5/2000 | C06D/5/00 |
| JP | 10-059792 | 3/1998 | C06D/5/00 |
| JP | 2000-103691 | 4/2000 | C06D/5/00 |
| WO | WO 98/23558 | 6/1998 | C06B/31/28 |

* cited by examiner

*Primary Examiner*—Aileen B. Felton
(74) *Attorney, Agent, or Firm*—Fish & Richardson P.C.

(57) ABSTRACT

A gas-generating composition is provided resistant to temperature changes between −40° C. and 100° C., repeated 200 times. The gas-generating composition includes a nitrogen compound stabilizer having nitrogen atom with an unpaired electron. The gas-generating composition is stabilized by the stabilizer by improving the adhesiveness between the organic binder and ammonium nitrate.

14 Claims, 2 Drawing Sheets

GAS-GENERATING COMPOSITIONS

BACKGROUND OF THE INVENTION

The present invention relates to gas-generating compositions, more specifically to gas-generating compositions that are filled in an air bag system that expands an air bag of a vehicle passenger-protecting apparatus, or a pretensioner device that takes up a seat belt.

The major components of the gas-generating compositions used in the conventional airbag systems are sodium azide and various oxidants. However, because sodium azide is toxic and difficult to handle, gas-generating compositions without sodium azide were needed.

Preferable gas-generating compositions may: not degrade naturally; be resistant to environmental changes at ambient temperature; have appropriate burning rate; generate a large amount of gas without generating carbon monoxide and combustion residue; and be inexpensive. In order to obtain preferable gas-generating compositions, gas-generating compositions that include ammonium nitrate as the major component have been developed. For example, Japanese Patent Application Laid-Open No. Hei 10-59792 discloses a gas-generating composition consisting of an oxygen-containing binder and ammonium nitrate. Also, Japanese Patent Application Laid-Open No. 2000-103691 discloses a gas-generating composition consisting of a macromolecular compound such as polyacrylic macromolecular compound, polyacetal, urea resin, melamine resin, ketone resin and cellulose macromolecular compound, and ammonium nitrate or phase-stabilized ammonium nitrate.

However, the performance could change in the conventional gas-generating compositions, due to ambient changes, such as temperature changes, received while loaded on the vehicles. In other words, the stability of the conventional gas-generating compositions against ambient changes was relatively low.

BRIEF SUMMARY OF THE INVENTION

An object of the present invention is to provide gas-generating compositions having improved stability against ambient changes.

To achieve the above object, the present invention provides a gas-generating composition including ammonium nitrate, an organic binder, and a stabilizer for stabilizing the gas-generating composition. The stabilizer consists of at least one nitrogen-containing compound having a nitrogen atom with an unpaired electron.

Another aspect of the present invention provides a gas-generating composition grain having a length and a radial dimension. The gas-generating composition grain contains ammonium nitrate, an organic binder, and a stabilizer for stabilizing the gas-generating composition. The stabilizer consists of at least one nitrogen-containing compound including a nitrogen atom with an unpaired electron. The minimum value among the length and the radial dimension is between 0.1 and 7 mm.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A gas-generating composition according to one embodiment of the present invention will be described in detail below.

The gas-generating composition of the present invention includes ammonium nitrate, an organic binder, and a stabilizer, which stabilizes the gas-generating composition against ambient changes.

Ammonium nitrate acts as an oxidant. The organic binder is a binder and fuel, which acts as a reductant. The stabilizer (or the first stabilizer) is provided to prevent performance changes of gas-generating compositions due to the surrounding ambient changes. The stabilizer is a nitrogen-containing compound having an unpaired electron on the nitrogen atom. The gas-generating composition can contain a combustion improving agent, an antidegradation agent (or the second stabilizer), and an additional oxidant (or the second oxidant).

Figure 1:
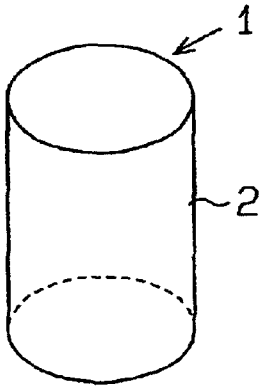
FIGS. 1(*a*) through 1(*h*) are perspective views of different gas-generating composition grains.
Figure 1:
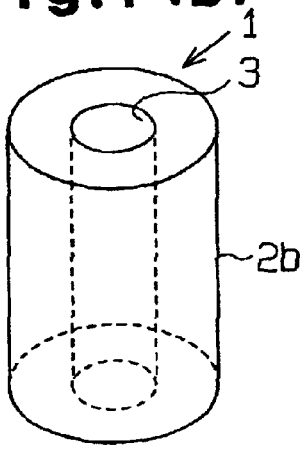
Figure 1:
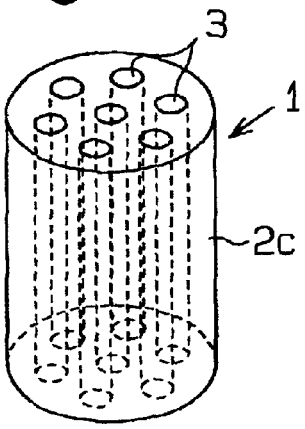
Figure 1:
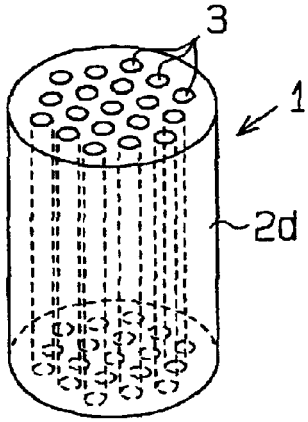
Figure 1:
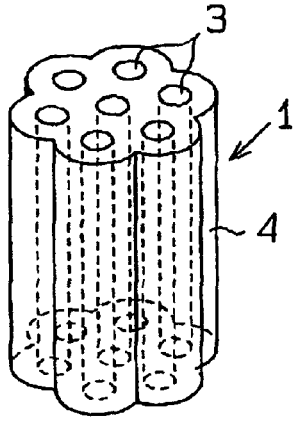
Figure 1:
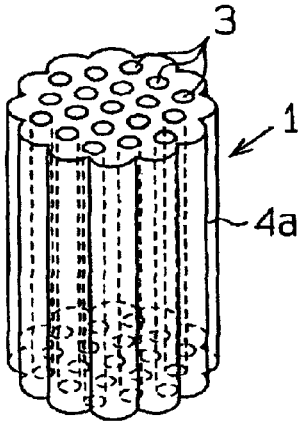
Figure 1:
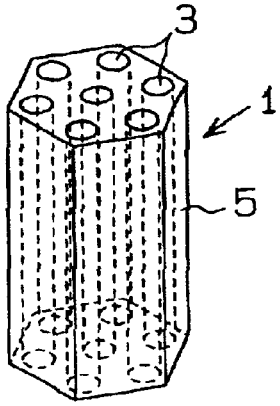
Figure 1:
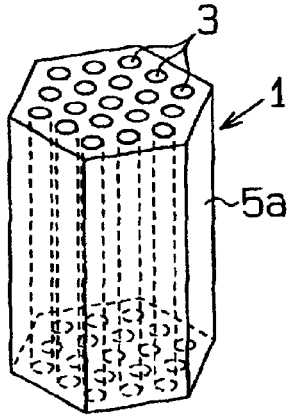

A gas-generating composition is molded to a grain having a predetermined shape. The gas-generating composition grain is preferably a column or a tube having at least one through-hole, as shown in FIG. 1. The minimum value among the length and the diameter of the grain is preferably between 0.1 and 7 mm. If the grain has through-holes, the minimum value among the length in axial or longitudinal axis (length or thickness), the length in a radial direction, and the wall thickness of the grain is preferably between 0.1 and 7 mm.

Ammonium nitrate is preferably in powder form, for the mixing and burning abilities. The average diameter of the granular ammonium nitrate is in a range between 1 and 1000 $\mu$m. Considering mechanical property and burning performance of the gas-generating composition grain, the average grain diameter is further preferred to be in a range between 1 and 500 $\mu$m. The average grain diameter is specifically preferred to be in a range between 1 and 200 $\mu$m.

Ammonium nitrate having average grain diameter less than 1 $\mu$m is difficult to manufacture. On the other hand, granular ammonium nitrate having average diameter exceeding 1000 $\mu$m is difficult to mix with an organic binder. Accordingly grains having undesirable mechanical property may be obtained. Further, granular ammonium nitrate exceeding 1000 $\mu$m decrease the burning rate of the gas-generating composition.

Preferable ammonium nitrate is phase transformation controlled ammonium nitrate, in which change in the crystalline structure due to temperature is controlled, or phase-stabilized ammonium nitrate. The phase-stabilized ammonium nitrate is obtained as described below. First, ammonium nitrate is melted, by heating the melting bath containing ammonium nitrate to a predetermined temperature. Zinc oxide, nickel oxide, copper oxide, potassium bromide, potassium nitrate, or potassium perchlorate, for example, is added into the melting bath, and then mixed with the ammonium nitrate. Phase-stabilized ammonium nitrate is next obtained by cooling the mixture while stirring. Alternatively, phase-stabilized ammonium nitrate is obtained by cooling while spraying the mixture using compressed air.

Ammonium nitrate is extremely hygroscopic. In order to prevent moisture absorption of ammonium nitrate, the surface of granular ammonium nitrate is preferably coated. Coating of ammonium nitrate is described.

First, the coating agent is dissolved into the organic solvent by heating and by mixing the organic solvent and the coating agent at between 70° C. and 80° C. in a container. Ammonium nitrate is successively added into the container. The mixture is cooled to room temperature while stirring. Coated ammonium nitrate is obtained by drying the cooled mixture.

A material capable of coating the surface of ammonium nitrate, and preventing moisture absorption, can be used as the coating agent. For example, polyglycol polymer such as polyethylene glycol, polyvinyl polymer, and paraffin wax are preferred. Among these, polyethylene glycol having relatively high moisture absorption preventing effect is most preferred. Polyethylene glycol having molecular weight between 6000 and 20000 is further preferred when considering the hygroscopicity of polyethylene glycol. As the coated ammonium nitrate is difficult to absorb moisture, the handling of ammonium nitrate is easy.

The amount of compounding ammonium nitrate is preferably between 80 and 94 wt % with respect to the total amount of the organic polymer binder and the stabilizer, and preferably between 85 and 93 wt % when considering the amount of gas generated by the gas-generating composition and that the carbon monoxide is not substantially generated. The content of the oxidant is specifically preferred to be between 89 and 92 wt %. When the content is less than 80 wt %, the amount of gas generation decreased, and there is a tendency to generate carbon monoxide within the generated gas. When the content exceeds 94 wt %, the burning rate is smaller and it is difficult to sustain combustion under relatively low pressure.

That "carbon monoxide does not substantially generate" means, throughout the Specification, that the concentration of carbon monoxide contained in the generated gas is 5 ppm or less.

The organic binder is next described. The following are the examples of the organic binders: cellulose polymers such as nitrocellulose, cellulose acetate, carboxymethylcellulose, hydroxyethylcelloluse, microcrystalline cellulose, cellulose acetate butylate, methylcellulose, ethylcellulose, cellulose acetate nitrate, and cellulose nitrate carboxymethylether, etc.; polyvinyl polymers such as polyvinyl alcohol, polyvinyl butylal, polyvinylether, and polyvinylformal, etc.; thermosetting elastomers such as polyester polymers, polyurethane polymers, polyether polymers, such as product name "PANDEX" of Dainippon Ink and Chemicals, Inc., product name "PELPRENE" of Toyobo Co., Ltd., product name KRAYTON of Shell Japan Ltd., etc.; oxetanes such as 3,3-bis(azidemethyl)oxetan, 3-azidemethyl-3-methyloxetan, 3-nitratemethyl-3-methyloxetan, etc.; polysaccharides such as guar gum and soluble starch; glycidyl azide polymer; and the mixture thereof.

The content of the organic binder is preferably between 5 and 15 wt % with respect to the total weight of ammonium nitrate, the organic binder, and the stabilizer. When the mechanical property, burning rate, and carbon monoxide concentration within the generated gas of the gas-generating composition are considered, the content of the organic binder is further preferably between 7 and 14 wt %, specifically between 6 and 13 wt %. When the content of the organic binder exceeds 15 wt %, though the mechanical property of the gas-generating composition grain is improved, the combustion performance of the gas-generating composition is degraded as the compounding rates of other ingredients decreased and therefore the burning rate tend to become slower. The gas-generating composition will generate carbon monoxide. The mechanical property of the gas-generating composition will degrade when the content of the organic binder is less than 5 wt %.

Next, the stabilizer will be described. A stabilizer is provided to prevent property degradation and the change in the combustion rate that occur as the gas-generating composition become vulnerable when the gas-generating composition including ammonium nitrate and the organic binder are subjected to the ambient changes, such as in a temperature cycle test. The stabilizer is a compound having a nitrogen atom with an unpaired electron. A stabilizer, which includes a nitrogen atom having unpaired electron, penetrates between ammonium nitrate and organic binder, and bond them. The nitrogen atom having unpaired electron in the stabilizer further forms a hydrogen bond with the ammonium ion of ammonium nitrate. Accordingly, since the stabilizer improves the adhesiveness between ammonium nitrate and the organic binder, the stability of the gas-generating composition is improved.

The weight average molecular weight of the stabilizer is preferably between 250 and 10000. A stabilizer having weight average molecular weight less than 250 is not preferable because the compatibility with the organic binder is relatively low. A stabilizer having weight average molecular weight exceeding 10000 makes the preparation of the gas-generating composition grains difficult because it is difficult to dissolve them in the organic solvent. The stabilizer is preferably amine, imine, amide, urethane or a mixture thereof.

As specific examples of the stabilizers, secondary or tertiary amines such as oxyethylene dodecylamine (for example product name NYMEEN L201 manufactured by NOF Corporation), polyoxyethylene dodecylamine (for example product name NYMEEN L202 manufactured by NOF Corporation), polyoxyethylene octadecylamine (for example product name NYMEEN S202 manufactured by NOF Corporation), and imines such as 1,1-(phenylenedicarbonyl)bis(2-methylaziridine) can be used. Oxyethylene dodecylamine (chemical formula $C_{12}H_{25}NHCH_2CH_2OH$) has unpaired electron on a nitrogen (N) atom.

Note that diphenylamine is inappropriate for the stabilizer, though it has a nitrogen atom having unpaired electron. This is because diphenylamine has inferior compatibility with the organic binder and because the atomic group (phenyl) bonded to the nitrogen atom of diphenylamine is not a long-chain group of straight chain.

The content of the stabilizer is preferably between 0.05 and 4 wt % with respect to the total weight of ammonium nitrate, the organic binder, and the stabilizer. When considering the combustion performance of the gas-generating composition and generation of carbon monoxide, the content is further preferably between 0.1 and 3 wt %, specifically between 0.1 and 2 wt %. The properties of the gas-generating composition degrade by the ambient changes when the content is less than 0.05 wt %. On the other hand, when the content exceeds 4 wt %, the burning rate of the gas-generating composition becomes slower, and carbon monoxide is generated within the generated gas.

The combustion-improving agent is next described. The combustion-improving agent is provided to increase the burning rate, and examples of them are highly energetic materials and combustion catalysts. RDX (trimethylene trinitroamine), HMX (tetramethylene tetranitroamine), PETN (pentaerythritol tetranitrate), TAGN (triamino guanidinenitrate) and HN (hydrazine sulfate) are the examples of the highly energetic materials.

As a combustion catalyst, oxides of transition metals such as copper oxide, iron oxide, manganese dioxide, and granular microcrystalline carbons such as activated carbon, coke, coal, animal charcoal, bone coal, acetylene black and carbon black can be given as the examples. Among these combustion-improving agents, activated carbon which ultimately increases the burning rate of the gas-generating composition is specifically preferred as the combustion improving agent.

The average grain diameter of the combustion improving agent is preferably between 1 and 500 $\mu$m from the standpoint of mechanical performance and combustion performance of the gas-generating composition grain, more preferably between 1 and 100 $\mu$m, and further preferably between 1 and 30 $\mu$m. The combustion improving agent of which average grain diameter is less than 1 $\mu$m is difficult to manufacture. On the other hand, the combustion-improving agent exceeding 500 $\mu$m in its average grain diameter has low compatibility with the organic binder, and degrades the mechanical property of the gas-generating composition grain. Further, the burning rate of the gas-generating composition is scarcely increased with such combustion-improving agent.

Considering the balance of the ease of handling, combustion performance and generation of carbon monoxide, the content of the combustion-improving agent is preferably 15 wt % or less in the gas-generating composition, further preferably between 1 and 10 wt %, and specifically between 1 and 5 wt %. While the effect of burning rate increase is larger when the combustion-improving agent exceeds 15 wt %, carbon monoxide is generated and the amount of gas generated tends to decrease as the compounding rates of other components decrease.

The antidegradation agent is next described. An antidegradation agent prevents natural deterioration of the gas-generating composition, specifically, it prevents decomposition of the components included in the gas-generating composition especially ammonium nitrate. The gas-generating composition including antidegradation agents is stable, and the performance deterioration is prevented even after a long time period. For example, decomposition of ammonium nitrate into $NO_x$, etc., may be prevented in the case where the gas-generating composition of the invention is loaded on a vehicle and left for several decades.

Examples of the antidegradation agents that can be used are: dephenylurea derivatives such as diphenylurea, methyldiphenylurea, ethyldiphenylurea, diethyldiphenylurea, dimethyldiphenylurea and methylethyldiphenylurea; diphenylamine derivatives such as diphenylamine and 2-nitrodiphenylamine; phenylurethane derivatives such as ethylphenylurethane and methylphenylurethane; diphenylurethane derivatives such as diphenylurethane; and resorcinol. Among these, diphenylamine and diethyldiphenylurea are preferable specifically, in that they facilitate the setting on fire of the gas-generating composition.

The content of the antidegradation agent is preferably 5 wt % or less in the gas-generating composition. In order to improve stability over time of the gas-generating composition and in order not to substantially generate carbon monoxide within the generated gas, the antidegradation agent is further preferably between 0.2 and 4 wt %, specifically between 0.2 and 3 wt %. When the antidegradation agent exceeds 5 wt %, the burning rate of the gas-generating composition becomes slower, and the gas-generating composition will generate carbon monoxide.

The additional oxidant is next described. The additional oxidant is provided to improve the combustion performance of the gas-generating composition and the types are not specifically limited. Preferably, nitrates, nitrites, halogen oxoacid salt, and perhalogen acid salt can be used as the additional oxidants.

As the nitrate additional oxidants, alkali metal salts of nitric acid such as sodium nitrate and potassium nitrate, and alkali earth metal salts of nitric acid such as barium nitrate and strontium nitrate can be used for example. As the nitrite additional oxidants, alkali metal salts of nitrous acid such as sodium nitrite and potassium nitrite, and alkali earth metal salts of nitrous acid such as barium nitrite and strontium nitrite can be used for example. As the halogen oxoacid salt additional oxidants, halogen acid salts and perhalogen acid salts can be used for example. As the halogen acid salt additional oxidant, alkali metal salts of halogen acids such as potassium chlorate and sodium chlorate, alkali earth metal salts of halogen acids such as barium chlorate and calcium chlorate, etc., and ammonium salts of halogen acids such as ammonium chlorate, etc., can be used. As the perhalogen acid salt additional oxidants, alkali metal salts of perhalogen acids such as potassium perchlorate and sodium perchlorate, alkali earth metal salts of perhalogen acids such as barium perchlorate and calcium perchlorate, and ammonium salts of perhalogen acids such as ammonium perchlorate, etc., can be used.

Considering the mixing of the ingredients and the combustion performance of the gas-generating composition, the additional oxidant is preferably granular. The average grain diameter of the granular additional oxidant is preferably in a range between 1 and 1000 $\mu$m. When considering the mechanical property and the combustion performance of the gas-generating composition grains, the average grain diameter is further preferably between 1 and 500 $\mu$m, and specifically between 1 and 200 $\mu$m.

If the average grain diameter is less than 1 $\mu$m, manufacture of the additional oxidant is difficult. On the other hand, additional oxidants of which average grain diameter exceeds 1000 $\mu$m are difficult to mix with the organic binder and degrades mechanic property of the grains. Further, such additional oxidant decreases the burning rate of the gas-generating composition.

From the aspect of the combustion performance and the generated amount of the gas, the content of the additional oxidant within the gas-generating composition is preferably 30 wt % or less, further preferably between 1 and 20 wt %, and specifically between 1 and 10 wt %. When the additional oxidant exceeds 30 wt %, while the burning rate of the gas-generating composition increase, the amount of gas generated is greatly decreased, and further, solid residues remain after the combustion of the gas-generating composition.

The method for manufacturing the gas-generating composition grains (extruding process) will be described next. First, ammonium nitrate, organic binder, stabilizer, if necessary, combustion-improving agent, antidegradation agent and additional oxidant are weighed. All of the ingredients, and organic solvent or water are charged in a kneader and mixed uniformly. The mixture is then charged into extruder provided with a die. By extruding the mixture from the extruder through the die, gas-generating composition grains having a predetermined shape and size are obtained.

A preferable organic solvent for extruding process may dissolve or swell the organic binder. As the organic solvent, acetone, methylalcohol, ethylalcohol, isopropylalcohol, ethyl acetate, butyl acetate, ethylether, toluene, methylethylketone and the mixture thereof can be used, for example. Acetone, ethylalcohol and ethyl acetate that are highly compatible with the organic binder are specifically preferable.

FIGS. 1(*a*) through 1(*h*) are perspective views of the gas-generating composition grains 1.

The gas-generating composition grains 1 can have various shapes, such as a cylinder 2 of FIG. 1(*a*), a tube 2*b* of FIG. 1(*b*) with one axial through-hole 3, a tube 2*c* of FIG. 1(*c*) with seven through-holes 3, or a tube 2*d* of FIG. 1(*d*) with nineteen through-holes 3. Furthermore, the shape of the molded gas-generating composition grains 1 can be a lobed tube 4 of FIG. 1(*e*) with seven through holes 3, a lobed tube 4*a* of FIG. 1(*f*) with nineteen through-holes 3, a hexagonal prism 5 of FIG. 1(*g*) with seven through-holes 3, or a hexagonal prism 5*a* of FIG. 1(*h*) with nineteen through-holes 3. The through-holes 3 are arranged in a regular hexagonal shaped region in the gas-generating composition grains 1 of FIGS. 1(*c*) through 1(*h*). Adjacent 3 through-holes 3 are arranged in an equilateral triangle. Namely all of the distances between adjacent two through-holes 3 are equal.

The minimum value among the length and the diameter of the gas-generating composition grains 1 is preferably between 0.1 and 7 mm. If the grain has one or more through-holes, the minimum value of the axial dimension (length or thickness), the radial dimension, and the wall thickness is preferably between 0.1 and 7 mm. Further, the diameter is preferably between 0.5 and 50 mm and the length is preferably between approximately 0.5 and 50 mm.

For instance, automotive seat belt pretensioner systems need to activate in an extremely short time, in concrete, in 5 to 20 ms when the automobile collided. Accordingly a column of FIG. 1(*b*) having wall thickness between 0.1 and 3.5 mm, diameter between 0.5 and 4 mm, through-hole diameter between 0.1 and 3.5 mm and length between 0.5 and 4 mm, or a column having 7 through-holes 3 of FIG. 1(*c*) having wall thickness between 0.1 and 3.5 mm, diameter between 0.5 and 4 mm, through-hole diameter between 0.1 and 1 mm and length between 0.5 and 4 mm are preferable. Note that a pretensioner system is a system that takes up slack in the seat belt and is activated by the gas pressure generated by combustion of the gas-generating compositions.

A gas-generating composition grain of which wall thickness is less than 0.1 mm and at least one of diameter and length is less than 0.5 mm is difficult to manufacture. It may be difficult to fill a necessary amount of gas-generating composition in the gas generator for the pretensioner system in case of a form of which diameter or length exceeds 4 mm because there remains a large space in the gas generator of the pretensioner system where the gas-generating composition is not yet filled. A form having wall thickness exceeding 3.5 mm is not preferable for a gas-generating composition used in pretensioner systems because of the time required for completing the combustion is long.

The timing for actuating an automotive air bag system is later than the timing for actuating a pretensioner system, specifically in between 30 and 75 ms after the collision of the automobile. Accordingly the gas-generating compositions for air bag systems need to complete combustion in 30 to 75 ms. Gas-generating composition grains preferable for the air bag systems are the grain having a through-hole 3 as shown in FIG. 1(*b*) of which wall thickness between 0.5 and 7 mm, diameter between 3 and 50 mm, through-hole diameter between 1 and 40 mm and length between 3 and 50 mm, or the grain having a plurality of through-holes 3 as shown in FIGS. 1(*c*) through 1(*h*) of which wall thickness between 0.5 and 7 mm, diameter between 3 and 50 mm, through-hole diameter between 1 and 10 mm and length between 3 and 50 mm.

There is a tendency that a necessary amount of gas-generating composition can not be filled in the gas generator used for an air bag system in the case in which the diameter or the length exceeds 50 mm. When the wall thickness exceeds 7 mm, the time required for completing the combustion becomes longer, and use of such form in the air bag systems is not preferable.

Since the combustion performance degrade when organic solvents such as acetone, ethylalcohol and ethyl acetate, etc., or water remain at a large amount, it is preferable to remove as much organic solvent or water as possible from gas-generating compositions. The gas-generating compositions after completing drying may preferably include organic solvent normally 0.8 wt % or less, and include water 1.5 wt % or less. Considering the handling after formation, it is further preferable that the amount of the organic solvent is 0.5 wt % or less and the amount of water is 1.0 wt % or less, and it is specifically preferable that the organic solvent amount is 0.3 wt % or less and water is 0.7 wt % or less. In the case that the amount of the organic solvent exceeds 0.8 wt % or that of water exceeds 1.5 wt %, the combustion property and the mechanical property tend to degrade.

A gas-generating composition of one embodiment has the advantages described as follows:

In a gas-generating composition of one embodiment, nitrogen atom within the stabilizer that has an unpaired electron forms hydrogen bond with the ammonium ion of ammonium nitrate. Further, the stabilizer is superior in compatibility with the organic binder. Accordingly the stabilizer mixes well with both ammonium nitrate and the organic binder. As a result, the gas-generating composition can sustain its primary performance, for example even after subjected to a temperature cycle test in which the temperature changes between −40° C. and 100° C. are repeated 200 times.

A stabilizer selected among amines, imines, amides and urethanes ensures preventing separation of ammonium nitrate from the organic binder when subjected to environmental changes.

Ammonium nitrate is contained in the gas-generating composition at an amount sufficient to convert all of the carbon atoms, which are included in the components subjected to oxidation in the gas-generating composition and having at least one of carbon and hydrogen atoms, into carbon dioxide, and all of the hydrogen atoms into water. Preferably ammonium nitrate is contained in the gas-generating composition in a stoichiometrical proportion by weight of between 1.0 and 1.4. By doing so, during the combustion, the gas-generating composition generates a gas that mainly includes carbon dioxide and water and carbon monoxide is not substantially generated.

In a gas-generating composition, ammonium nitrate is included at between 80 and 94 wt %, organic binder, between 5 and 15 wt %, and stabilizer, between 0.05 and 4 wt %. Such compounding sets the content of ammonium nitrate, a granular component, in an appropriate range to maintain the mechanical property. Further, the ratio between ammonium nitrate, the oxidant, and the organic binder, the reductant (fuel), is set in an appropriate range. Accordingly, the gas-generating composition burns at a preferable rate in the combustion of the gas-generating composition, and a gas that may not substantially include carbon monoxide can be generated at a relatively large amount.

By selecting the organic binder among cellulose polymers, polyvinyl polymer, polyester polymer, polyurethane polymer, polyether polymer, thermosetting elastomers, oxetanes and polysaccharides, each component of the gas-generating composition is sufficiently bonded and the formability of the gas-generating composition can be improved.

Stabilizers and organic binders mix well through an organic solvent. Thus a gas-generating composition including a stabilizer can be easily manufactured.

EXAMPLES

Examples and comparative examples are given below to describe an embodiment mode of the invention in more detail.

Example 1

A mixture of ammonium nitrate having average grain diameter 15 $\mu$m at 89.1 wt %, cellulose acetate at 8.3 wt % and polyoxyethylene dodecylamine (produced by NOF Corporation by product name NYMEEN L202) at 0.5 wt %, activated carbon having the specific surface area approximately 950 $m^2/g$ at 1.6 wt % and diphenylamine at 0.5 wt % was prepared. Ethyl acetate at 50 wt % was added to the mixture and mixed uniformly in a Werner-type kneader. Note that a Werner-type kneader is a mixer equipped with at least a stirring blade.

The kneaded material was next charged in an extruder. A die having through-holes of 6.4 mm diameter and 7 pins having 0.6 mm diameter were attached to the extruder in advance. The kneaded material is extruded through the die, and the grains having 7 through-holes were obtained. The grains were cut into 4.0 mm length, dried and the granular gas-generating composition grains (test pieces) were obtained.

Stability of gas-generating composition grains against heat changes (ambient changes) was measured through a temperature cycle test. Property changes in the gas-generating composition grains before and after the temperature cycle test were tested. Specifically, the mechanical property of the gas-generating composition grain was measured by using compression testing device and the burning rate of the gas-generating composition grain was obtained by using hermetic sealed bomb testing device.

Method for Temperature Cycle Test

A sample bottle containing weighed test piece was placed in a thermal shock testing device. The temperature in the thermal shock testing device was kept at −40° C., for 5 minutes. The temperature in the thermal shock testing device was increased to +100° C. rapidly, in concrete within 3 minutes and then held at +100° C. for 5 minutes. The temperature in the thermal shock testing device was dropped to −40° C. in 3 minutes and the temperature was kept at −40° C. for 5 minutes. This cycle is repeated 200 times. Such testing is referred to as temperature cycle test (between −40° C. and 100° C.). A preferable gas-generating composition is one in which the performance may not substantially change even after the temperature cycle test.

Measurement of Mechanical Property

The method of compressive strength testing is described. The compressive strength of a gas-generating composition was tested by using Kiya-type digital hardness meter manufactured by Fujiwara Seisakusho. The test piece placed in the center of the sample table was compressed by a compressing cylinder. The mechanical property was evaluated based on the value (pressure) at the point when the test piece was destroyed.

Burning Rate Measurement

Figure 2:
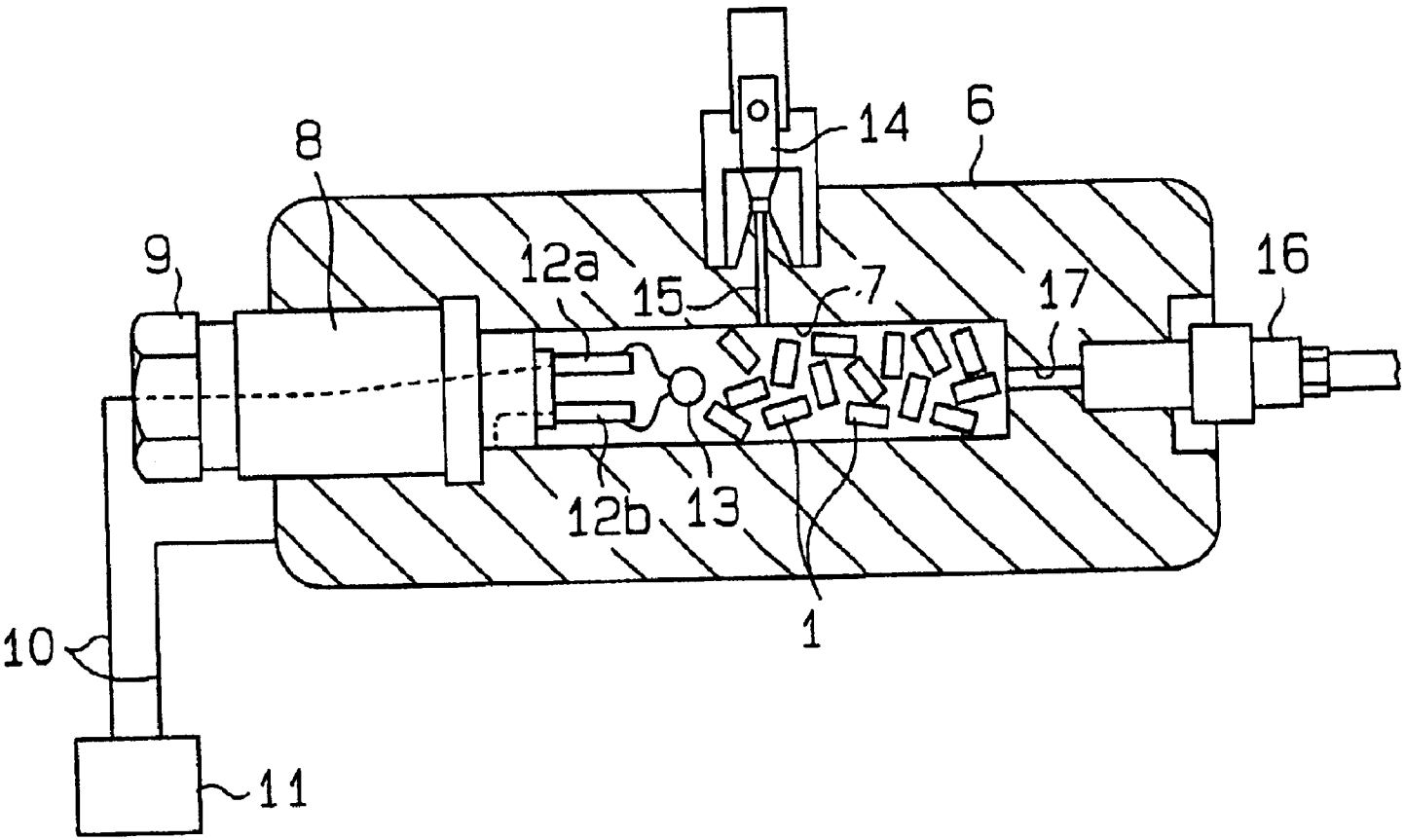
FIG. 2 is a longitudinal cross sectional view of a closed type combustion testing apparatus that is used to test combustion of the gas-generating composition grains of the present invention.

Construction of the closed type combustion testing apparatus will now be described. As shown in FIG. 2, a combustion chamber 7 having a predetermined volume is provided in a main body 6 of the combustion testing apparatus. A gas-generating composition (test piece) 1 was loaded in the combustion chamber 7. An ignition plug 8 is mounted on the first end of the main body 6 (left side of FIG. 2) and it was detachable by bolt 9. The plug 8 normally seals the combustion chamber 7. The ignition plug 8 was removed from the main body 6 when loading the test piece 1 into the combustion chamber 7. An igniter 11 was connected to the main body 6 through wires 10.

A pair of electrodes 12*a*, 12*b* extends from an inner end of the ignition plug 8. The first electrode 12*a* is connected to the first wire 10, and the second electrode 12*b* is connected to the main body 6. A fuse head 13 is connected to both the electrodes 12*a*, 12*b* by connecting wires. When the igniter 11 is activated, the fuse head 13 is ignited. Then, the test grains 1 are ignited and are combusted.

A gas vent valve 14 is provided at an upper side of the main body 6 and is communicated with the combustion chamber 7 through a sampling tube 15. The gas in the combustion chamber 7 is sampled through the gas vent valve 14. The combustion characteristics of the gas-generating composition test grains 1 are evaluated from the constituents of the combustion gas. A pressure sensor 16 is connected to a second end (on right side of FIG. 2) of the main body 6 and is communicated with the combustion chamber 7 through a communicating tube 17. The relationship between time and developed gas pressure during combustion of the test grains 1 is measured with the pressure sensor 16.

A test was conducted as follows. The gas-generating composition test grains 1 were loaded in the combustion chamber 7 while the ignition plug 8 was removed from the main body 6. The loading density of the test grains 1 was 0.1 $g/cm^3$. After the ignition plug 8 was connected to the main body 6, the igniter 11 was activated to combust the test grains 1. After combustion of the test grains 1, the combustion gas was sampled through the gas vent valve 14. The collected gas was analyzed by gas chromatography to measure the carbon monoxide concentration of the combustion gas. Then, the ignition plug 8 was removed to collect the combustion residue, and the weight of the combustion residue was measured. The relationship between time and gas pressure development during the combustion of the test grains 1 was measured by an oscilloscope (not shown) through the pressure sensor 16. The result is shown in Table 1.

Examples 2 through 9

Test pieces of gas-generating compositions were manufactured from the ingredients shown below through similar processes as Example 1 and they were tested by the same method as Example 1. The results are shown in Table 1. An ingredient "PELPRENE" among the gas-generating compositions of Examples 7 through 9 is a product name of a thermosetting elastomer manufactured by Toyobo Co., Ltd.

| Components of Example 2 | |
|---|---|
| Ammonium nitrate | 88.9 wt % |
| Cellulose acetate | 8.5 wt % |
| NYMEEN L202 | 0.1 wt % |
| activated carbon | 1.8 wt % |
| diphenylamine | 0.7 wt % |

| Components of Example 3 | |
|---|---|
| Ammonium nitrate | 88.9 wt % |
| Cellulose acetate | 6.4 wt % |
| NYMEEN L202 | 3.5 wt % |
| activated carbon | 0.9 wt % |
| diphenylamine | 0.3 wt % |

| Components of Example 4 | |
|---|---|
| Ammonium nitrate | 80.5 wt % |
| nitrocellulose | 12.5 wt % |
| NYMEEN L202 | 0.5 wt % |
| copper oxide | 3.5 wt % |
| diphenylamine | 3.0 wt % |

| Components of Example 5 | |
|---|---|
| Ammonium nitrate | 80.5 wt % |
| nitrocellulose | 12.9 wt % |
| NYMEEN L202 | 0.1 wt % |
| copper oxide | 3.5 wt % |
| diphenylamine | 3.0 wt % |

-continued

| Components of Example 6 | |
|---|---|
| Ammonium nitrate | 80.5 wt % |
| nitrocellulose | 9.5 wt % |
| NYMEEN L202 | 3.5 wt % |
| copper oxide | 3.5 wt % |
| diphenylamine | 3.0 wt % |

| Components of Example 7 | |
|---|---|
| Ammonium nitrate | 86.0 wt % |
| PELPRENE | 10.5 wt % |
| NYMEEN L202 | 0.5 wt % |
| copper oxide | 3.0 wt % |

| Components of Example 8 | |
|---|---|
| Ammonium nitrate | 86.0 wt % |
| PELPRENE | 10.9 wt % |
| NYMEEN L202 | 0.1 wt % |
| copper oxide | 3.0 wt % |

| Components of Example 9 | |
|---|---|
| Ammonium nitrate | 86.0 wt % |
| PELPRENE | 7.5 wt % |
| NYMEEN L202 | 3.5 wt % |
| copper oxide | 3.0 wt % |

TABLE 1

| | Shape | | | Before temperature cycle test | | After temperature cycle test | |
|---|---|---|---|---|---|---|---|
| Exp. No. | Diameter (mm) | Penetration diameter (mm) | Wall thickness (mm) | Compressive strength (N) | Combustion time (ms) | Compressive strength (N) [rate of change] | Combustion time (ms) [rate of change] |
| 1 | 5.76 | 0.56 | 1.02 | 121.6 | 50.0 | 116.7 [−4.0] | 48.8 [+2.4] |
| 2 | 5.72 | 0.52 | 1.04 | 109.8 | 45.9 | 99.0 [−9.8] | 43.7 [+4.8] |
| 3 | 5.80 | 0.56 | 1.03 | 145.1 | 71.0 | 142.2 [−2.0] | 71.7 [+1.0] |
| 4 | 5.82 | 0.57 | 1.03 | 160.8 | 40.0 | 154.0 [−4.2] | 38.9 [+2.8] |
| 5 | 5.72 | 0.56 | 1.01 | 129.4 | 35.4 | 118.7 [−8.3] | 32.3 [+8.8] |
| 6 | 5.78 | 0.54 | 1.04 | 168.7 | 58.3 | 167.7 [−0.6] | 57.7 [+1.0] |
| 7 | 5.75 | 0.54 | 1.03 | 193.2 | 54.5 | 185.3 [−4.1] | 52.6 [+3.5] |
| 8 | 5.80 | 0.57 | 1.02 | 157.9 | 49.1 | 140.2 [−11.2] | 44.1 [+10.2] |
| 9 | 5.73 | 0.53 | 1.04 | 197.1 | 73.9 | 195.2 [−1.0] | 72.2 [+2.3] |

Comparative Examples 1 and 2

Gas generation compositions of comparative examples 1 and 2 were manufactured from the components shown below through the method similar to that of Example 1. The gas-generating compositions of Comparative Examples 1 and 2 did not contain stabilizers. The properties of gas-generating compositions of the comparative examples 1 and 2 were evaluated by the same method as Example 1. The results are shown in Table 2.

| Components of Comparative Example 1 | |
|---|---|
| Ammonium nitrate | 88.9 wt % |
| Cellulose acetate | 8.6 wt % |
| activated carbon | 1.8 wt % |
| diphenylamine | 0.7 wt % |
| Components of Comparative Example 2 | |
| Ammonium nitrate | 80.5 wt % |
| Cellulose acetate | 13.0 wt % |
| Copper oxide | 3.5 wt % |
| diphenylamine | 3.0 wt % |

TABLE 2

| | Shape | | | Before temperature cycle test | | After temperature cycle test | |
|---|---|---|---|---|---|---|---|
| Exp. No. | Diameter (mm) | Penetration diameter (mm) | Wall thickness (mm) | Compressive strength (N) | Combustion time (ms) | Compressive strength (N) [rate of change] | Combustion time (ms) [rate of change] |
| 1 | 5.79 | 0.57 | 1.02 | 102.0 | 46.2 | 43.1 [−57.7] | 27.9 [+39.6] |
| 2 | 5.79 | 0.56 | 1.03 | 121.6 | 41.5 | 61.8 [−49.2] | 23.4 [+43.6] |

As shown in Table 1, the rate of change in the compressive strength after temperature cycle test in Example 1 was −4.0% and the rate of change in burning rate was +2.4%. This rate of change was smaller than the conventional gas-generating compositions and the stability of the gas-generating composition was enhanced. The stability was enhanced because nitrogen-containing stabilizer (polyoxyethylene dodecylamine) improved the adhesiveness between ammonium nitrate and cellulose acetate to prevent separation of ammonium nitrate from cellulose acetate.

In Example 2 in which less stabilizer was contained than Example 1, the rate of change in the compressive strength after temperature cycle test is −9.8% and the rate of change in the burning rate was +4.8%. Though the performance has slightly degraded compared to Example 1, the rate of change was smaller than the conventional gas-generating compositions and the stability of the gas-generating composition proved to have enhanced.

In Example 3 in which more stabilizer than Example 1 was contained, the performance degradation of the gas-generating composition after the temperature cycle test was scarcely found and the stability of the gas-generating composition proved to have enhanced. On the other hand, the time for completing combustion was longer because the compounding ratio or the components other than the stabilizer were low, however the extension of the time for completing combustion was within a range that may not greatly affect the use of the gas-generating composition.

The effect of the stabilizer was confirmed in Examples 4 through 6 using nitrocellulose binder and also in Examples 7 through 9 using thermosetting elastomer. Further, no problem arose with respect to the time for combustion completion.

The carbon monoxide concentration contained in the combustion gas was measured by KITAGAWA gas detector tube system. The gas detector tube system indicates carbon monoxide concentrations by the degree of the color change and the minimum concentration detected is 5 ppm. The combustion gases of Examples 1 through 9 did not make the color change of the gas detector tube system. Accordingly it was proved that the generated gases did not substantially contain carbon monoxide. Therefore the gas-generating compositions of Examples 1 through 9 were suitable for the gas-generating compositions for vehicle passenger protecting apparatuses.

As shown in Table 2, the compressive strength was reduced by approximately 50% by the temperature cycle test and the time for combustion completion was extended by approximately 40% in Comparative Examples 1 and 2. This means that the separation of ammonium nitrate and organic binder took place due to the temperature cycle test because no stabilizer was contained, to degrade the mechanical property and the combustion performance of the gas generation compositions degraded. Accordingly the gas-generating compositions of Comparative Examples 1 and 2 have low temperature stability and were inappropriate for the gas-generating compositions for vehicle passenger protecting apparatuses. In other words, it was proved that the stabilizers held the gas-generating composition stable, and prevent the performance change when subjected to temperature changes from the results of Examples 1 through 9 and Comparative Examples 1 and 2.

Note that one embodiment of the invention may be altered as follows:

The gas-generating composition grain may be formed into an equilateral triangle tube or a tube having 3 through-holes that are evenly arranged.

A silicone resin binder with or without crosslink may be used as the organic binder.

A thickner such as silica, polytetrafluoroethylene, carbon black, etc., and/or additives such as iron oxide can be further contained in the gas-generating compositions.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A gas-generating composition comprising:

ammonium nitrate;

an organic binder; and a stabilizer for preventing performance changes of the gas-generating composition due to ambient changes, wherein the stabilizer consists of at least one nitrogen-containing compound having a nitrogen atom with an unpaired electron, in which the nitrogen atom is bonded to a long chain group.

2. The gas-generating composition according to claim 1, wherein the at least one nitrogen-containing compound is selected from a group consisting of amines, imines, amides, urethanes and a mixture thereof.

3. The gas-generating composition according to claim 1, wherein the weight average molecular weight of the at least one nitrogen-containing compound is between 250 and 10000.

4. The gas-generating composition according to claim 1, wherein the at least one nitrogen-containing compound is selected from a group consisting of oxyethylene dodecylamine, polyoxyethylene dodecylamine, polyoxyethylene octadecylamine, and a mixture thereof.

5. The gas-generating composition according to claim 1, wherein the ammonium nitrate is contained in the gas-generating composition at a stoichiometrical proportion of 1.0 to 1.4 with respect to components having at least one of hydrogen and carbon atoms that are subjected to oxidation within the gas-generating compositions.

6. The gas-generating composition according to claim 1, wherein the gas-generating composition contains the ammonium nitrate at an amount enough to convert all carbon atoms in the gas-generating composition into carbon dioxide and to convert all hydrogen atoms in the gas-generating composition into water.

7. The gas-generating composition according to claim 1, wherein the weight percent of the ammonium nitrate is between 80 and 94%, the weight percent of the organic binder is between 5 and 15% and the weight percent of the stabilizer is between 0.05 and 4% with respect to the total weight of the gas-generating composition.

8. The gas-generating composition according to claim 1, wherein the organic binder is selected from the group consisting of cellulose polymers, polyvinyl polymers, thermosetting elastomers including polyester polymers, polyurethane polymers and polyether polymers, oxetanes, polysuccharides, and mixtures thereof.

9. The gas-generating composition according to claim 1 further comprising a combustion-improving agent that increases the burning rate of the gas-generating composition.

10. The gas-generating composition according to claim 1 further comprising an antidegradation agent which prevents natural degradation of the gas-generating composition.

11. The gas-generating composition according to claim 1 further comprising an additional oxidant for improving the combustion performance of the gas-generating composition.

12. The gas-generating composition according to claim 1, wherein the gas-generating composition is useful for vehicle passenger protecting apparatus and can withstand temperature changes between −40° C. and 100° C. that are repeated 200 times.

13. A gas-generating composition grain having a length and a radial dimension, comprising:

ammonium nitrate;

an organic binder;

a stabilizer for preventing performance changes of the gas-generating composition due to ambient changes, wherein the stabilizer consists of at least one nitrogen-containing compound including a nitrogen atom with an unpaired electron, in which the nitrogen atom is bonded to a lone chain group, and wherein the minimum value among the length and the radial dimension is between 0.1 and 7 mm.

14. The gas-generating composition grain according to claim 13, wherein the grain is a tube having at least one wall that defines at least one through-hole extending in an axial direction, wherein the minimum value among the length, the radial dimension, and the thickness of the wall is between 0.1 and 7 mm.

* * * * *

UNITED STATES PATENT AND TRADEMARK OFFICE

CERTIFICATE OF CORRECTION

PATENT NO. : 6,811,626 B2
DATED : November 2, 2004
INVENTOR(S) : KatsuhikoTakahashi and Kazuya Serizawa It is certified that error appears in the above-identified patent and that said Letters Patent is hereby corrected as shown below:

Title page,
Item [*] Notice, after the first paragraph insert -- This patent is subject to a terminal disclaimer. --

Signed and Sealed this

Fifth Day of April, 2005

JON W. DUDAS
*Director of the United States Patent and Trademark Office*